US010745852B2

(12) United States Patent
Nam et al.

(10) Patent No.: US 10,745,852 B2
(45) Date of Patent: Aug. 18, 2020

(54) LAUNDRY TREATING APPARATUS

(71) Applicant: LG Electronics Inc., Seoul (KR)

(72) Inventors: Hyunsu Nam, Seoul (KR); Junseok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/202,498

(22) Filed: Nov. 28, 2018

(65) Prior Publication Data

US 2019/0161904 A1 May 30, 2019

(30) Foreign Application Priority Data

Nov. 28, 2017 (KR) ..... 10-2017-0161017
Nov. 28, 2017 (KR) ..... 10-2017-0161034

(51) Int. Cl.

| | |
|---|---|
| ***D06F 58/04*** | (2006.01) |
| ***D06F 58/20*** | (2006.01) |
| ***E05D 11/00*** | (2006.01) |
| ***D06F 39/14*** | (2006.01) |
| ***E05B 9/02*** | (2006.01) |
| ***E05B 9/00*** | (2006.01) |

(52) U.S. Cl.

CPC ..... *D06F 58/04* (2013.01); *D06F 39/14* (2013.01); *D06F 58/20* (2013.01); *E05B 9/02* (2013.01); *E05D 11/0054* (2013.01); *E05B 2009/008* (2013.01); *E05D 2011/0072* (2013.01); *E05Y 2900/312* (2013.01)

(58) Field of Classification Search

CPC ..... D06F 58/04; D06F 39/14; D06F 58/20; E05B 9/02; E05B 2009/008; E05D 11/0054; E05D 2011/0072; E05Y 2900/312

See application file for complete search history.

(56) References Cited

U.S. PATENT DOCUMENTS 9,752,272 B2 9/2017 Yeom et al.
10,060,066 B2 * 8/2018 Anand ..... D06F 37/28
(Continued)

FOREIGN PATENT DOCUMENTS

AU 2006201708 5/2006
CN 101333755 12/2008
(Continued)

OTHER PUBLICATIONS

Extended European Search Report in European Appln. 18208834.4, dated Apr. 17, 2019, 9 pages.
(Continued)

*Primary Examiner* — Hanh V Tran
(74) *Attorney, Agent, or Firm* — Fish & Richardson P.C.

(57) ABSTRACT

In one aspect of the present disclosure, a laundry treating apparatus includes a door including: a door cover; and a door frame coupled to a rear surface of the door cover. A left cover seating portion and a right cover seating portion are respectively defined in a left edge and a right edge of a rear surface portion of the door frame. The left cover seating portion and the right cover seating portion are shaped to be symmetrical with each other with respect to a vertical line bisecting the door horizontally. Each of the left cover seating portion and the right cover seating portion is shaped to be symmetrical with respect to a horizontal line bisecting the door vertically.

19 Claims, 16 Drawing Sheets

(56) References Cited

U.S. PATENT DOCUMENTS

| | | | | |
|---|---|---|---|---|
| 10,132,021 | B2 * | 11/2018 | Harbrecht | D06F 37/28 |
| 2004/0107741 | A1 * | 6/2004 | Kim | D06F 37/28 68/24 |
| 2007/0130730 | A1 * | 6/2007 | Cho | D06F 39/14 16/387 |
| 2010/0026015 | A1 * | 2/2010 | Joerger | D06F 37/28 292/254 |
| 2010/0088917 | A1 * | 4/2010 | Lim | D06F 58/04 34/88 |
| 2011/0023316 | A1 * | 2/2011 | Schone | D06F 39/14 34/88 |
| 2011/0023559 | A1 | 2/2011 | Schöne | |
| 2011/0025178 | A1 * | 2/2011 | Schone | D06F 39/14 312/228 |
| 2012/0007482 | A1 * | 1/2012 | Pillot | D06F 37/28 312/228 |
| 2012/0086315 | A1 * | 4/2012 | Da Riol | D06F 39/14 312/228 |
| 2012/0144750 | A1 * | 6/2012 | Sartor | D06F 39/14 49/399 |
| 2013/0076220 | A1 | 3/2013 | Yeom et al. | |
| 2014/0009049 | A1 * | 1/2014 | Sung | D06F 37/28 312/228 |
| 2014/0191643 | A1 * | 7/2014 | Lee | B29C 45/16 312/326 |
| 2014/0319983 | A1 * | 10/2014 | Park | A47B 96/00 312/228 |
| 2015/0000200 | A1 * | 1/2015 | Kim | D06F 39/14 49/460 |
| 2015/0123525 | A1 | 5/2015 | Woo et al. | |
| 2015/0315740 | A1 * | 11/2015 | Buso | D06F 39/14 312/329 |
| 2016/0208427 | A1 * | 7/2016 | Pillot | D06F 39/14 |
| 2016/0369445 | A1 * | 12/2016 | Kim | D06F 39/14 |
| 2017/0121898 | A1 * | 5/2017 | Kwon | D06F 39/14 |
| 2017/0137989 | A1 * | 5/2017 | Choi | D06F 39/14 |
| 2018/0127911 | A1 * | 5/2018 | Chen | D06F 39/00 |
| 2018/0142399 | A1 | 5/2018 | Chun et al. | |
| 2018/0216282 | A1 * | 8/2018 | Lee | D06F 39/14 |
| 2018/0363188 | A1 * | 12/2018 | Gim | D06F 17/06 |
| 2018/0363198 | A1 * | 12/2018 | Gim | D06F 37/263 |

FOREIGN PATENT DOCUMENTS

| | | |
|---|---|---|
| DE | 102011078920 | 1/2013 |
| EP | 2253756 | 11/2010 |
| EP | 2738299 | 7/2015 |
| EP | 2732088 | 8/2015 |
| KR | 10-2006-0100682 | 9/2006 |
| KR | 1020120076884 | 7/2012 |
| KR | 10-2015-0131532 | 11/2015 |
| KR | 1020160134625 | 11/2016 |
| KR | 1020170014256 | 2/2017 |
| KR | 101772971 | 9/2017 |
| WO | WO2015144236 | 10/2015 |

OTHER PUBLICATIONS

EP Office Action in European Application No. 18208834.4, dated Mar. 9, 2020, 6 pages.

* cited by examiner

LAUNDRY TREATING APPARATUS

CROSS-REFERENCE TO RELATED APPLICATIONS

This application claims the benefit of Korean Application No. 10-2017-0161034, filed on Nov. 28, 2017, and Korean Application No. 10-2017-0161017, filed on Nov. 28, 2017. The disclosures of the prior applications are incorporated by reference in their entirety.

FIELD

The present disclosure relates to a laundry treating apparatus.

BACKGROUND

The laundry treating apparatus may include a washing machine to remove contaminants from the laundry, a drying machine to dry the laundered laundry, and a clothes handler to remove the absorbed smell from the laundry and to wrinkle the garment.

Specifically, a washing machine or a drying machine generally includes a body having a laundry receiving hole defined in its front surface portion and a drum mounted therein, and a door that pivotally connects to the body to open and close the laundry receiving hole. The door is hinge-coupled to the left or right edge of the laundry receiving hole, and pivotally coupled thereto about a vertical axis, depending on the location of the washing machine or the drying machine.

Since the installation position of the washing machine or the drying machine is not fixed, the coupling structure between the door and the body is designed by selectively connecting the hinge, which is the pivot center of the door, to either the left edge or the right edge of the laundry receiving hole.

Prior art 1 discloses a configuration in which the door can be pivoted clockwise or counterclockwise by 180 degrees to change the position of the handle and hinge of the door in the opposite direction.

In prior art 2, a plurality of hinge structures are formed at the edge of the laundry receiving hole to allow selection of the pivot shaft of the door.

However, in the case of the prior art 1, there is a restriction that only when the shape and structure of the door are symmetrical with respect to the horizontal line passing through the center of the door, the hinge position of the door may be changed. That is, only when the shape of the door glass protruding to the rear of the door is symmetrical with respect to the horizontal line, it is possible to change the pivot shaft of the door by rotating the door 180 degrees clockwise.

Further, in the case of prior art 2, to change the pivot shaft of the door, the hinge structures are mounted on all of the plurality of points at which the pivot shaft is intended to be installed. Therefore, not only the manufacturing cost is increased but also the vertical load is excessively applied to the front panel in which the laundry receiving hole is defined.

Further, in the case of the door coupled to a conventional laundry treating apparatus, since the hinge assembly is fixed to the door rear surface by a fastening boss, the load of the door is concentrated on the fastening boss, and thus door sagging phenomenon and door breakage phenomenon frequently occur.

Prior Art 1: Korean Patent Application Publication No. 10-2006-0100682 (Sep. 21, 2006)

Prior Art 2: Korean Patent Publication Application No. 10-2015-0131532 (Nov. 25, 2015)

SUMMARY

The present disclosure is intended to solve the above problems.

In one aspect of the present disclosure, there is provided a laundry treating apparatus comprising: a cabinet having a laundry receiving hole defined in a front surface portion thereof; a door pivotally coupled to the front surface of the cabinet for selectively opening and closing the laundry receiving hole, the door including: a door cover defining a front appearance; and a door frame coupled to a rear surface of the door cover; a latch assembly coupled to a rear surface edge of the door, the latch assembly including: a latch cover coupled to the door cover; and a latch protruding from the latch cover; and a hinge assembly configured to pivotally connect the door to a front surface of the cabinet, wherein the hinge assembly includes: a hinge base; a hinge cover coupled to a front surface of the hinge base; and a hinge body pivotally coupled to the hinge cover, wherein a left cover seating portion and a right cover seating portion are respectively defined in a left edge and a right edge of a rear surface portion of the door frame, wherein the left cover seating portion and the right cover seating portion are shaped to be symmetrical with each other with respect to a vertical line bisecting the door horizontally, wherein each of the left cover seating portion and the right cover seating portion is shaped to be symmetrical with respect to a horizontal line bisecting the door vertically.

According to the laundry treating apparatus according to the embodiment of the present disclosure constituting the above, the following effects are obtained.

First, in order to assemble the door, only the mounting position of the hinge assembly and door latch assembly needs to be changed without rotating the door clockwise or counterclockwise. Thus, the door assembly process may be simplified.

In detail, when there are present a body model of the laundry treating apparatus, in which the hinge coupled portion and the door latch coupled portion are defined in the left edge and the right edge, respectively, and a body model of the laundry treating apparatus, in which the hinge coupled portion and the door latch coupled portion are defined respectively defined in the right and left edges, only a single type of a door is manufactured regardless of the model of the body of the laundry treating apparatus. Further, the hinge assembly and latch assembly are selectively mounted onto between the left and right edges of the rear surface of the door.

When the edge fastener or fastening hole on the laundry receiving hole to which the hinge assembly is coupled and the edge fastener or the fastening hole on the laundry receiving hole to which the door latch housing is coupled are shaped to be symmetrical in the up-down direction and the left-right direction, positions of the hinge shaft of the door and the latch thereof may be freely changed without rotating the door clockwise or counterclockwise depending on the installation position of the laundry treating apparatus, even in the case of a laundry treating apparatus having a single design.

Second, since the hinge assembly is combined with the door cover constituting the front surface of the door and the door frame constituting the rear surface of the door, the load of the door is dispersed to the door cover and the door frame, so that the door sagging phenomenon and the door breakage phenomenon can be minimized.

Third, when the hinge assembly is coupled to the door, the fastening member is inserted in the forward and backward direction of the door, and, at the same time, the fastening member is inserted in the center direction from the outer edge of the door. Thus, there is an advantage that the door may be more effectively prevented from sagging down by gravity.

Fourth, since the hinge assembly is provided in a module form, the assembly process of joining the hinge assembly to the door rear surface may be simplified.

DETAILED DESCRIPTION

Hereinafter, a door fastening structure of a laundry treating apparatus according to an embodiment of the present disclosure will be described in detail with reference to the drawings.

Hereinafter, as an example of the laundry treating apparatus, a heat pump type laundry drying machine will be described as an example.

Figure 1:
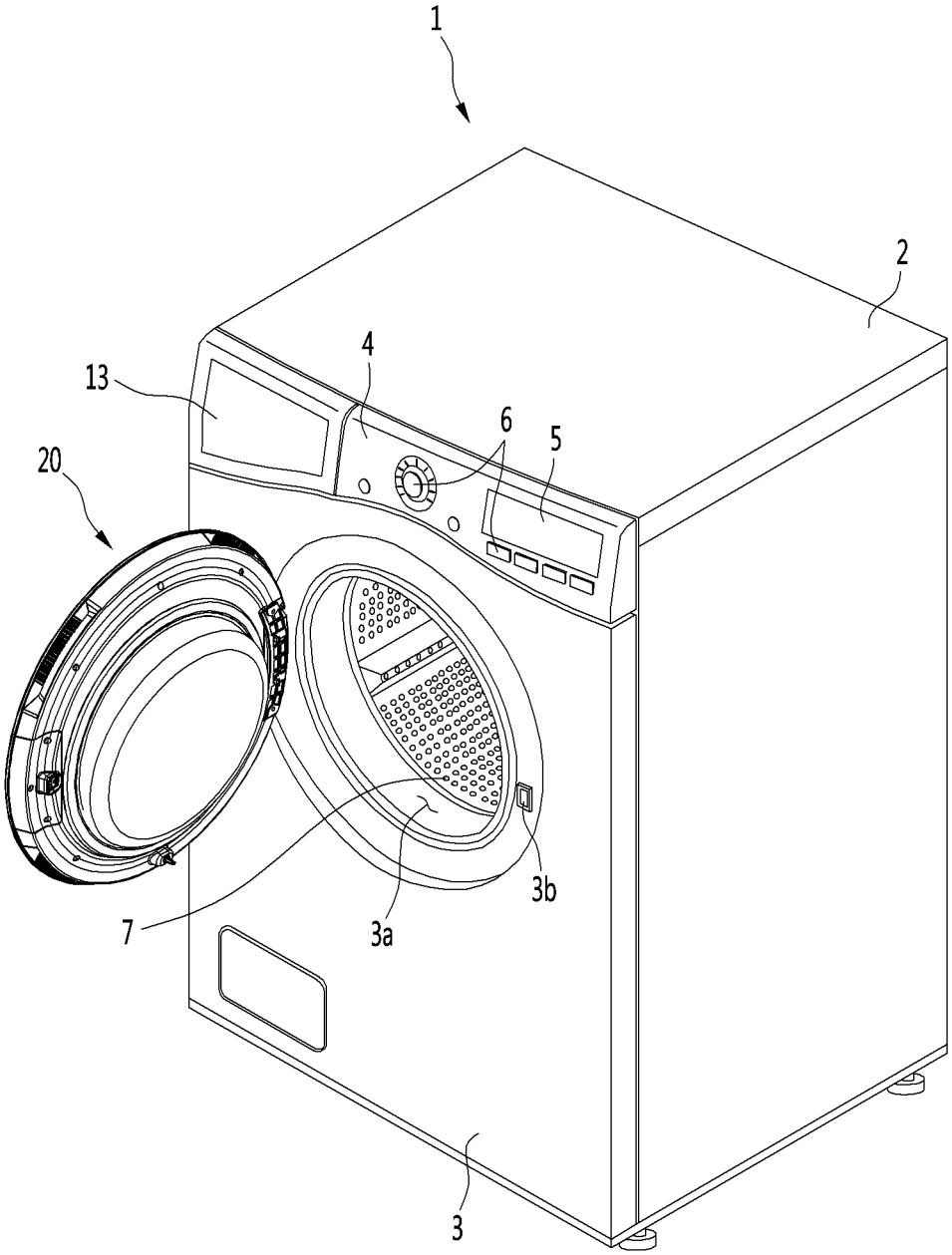
FIG. 1 is a perspective view of a laundry treating apparatus having a door fastening structure according to an embodiment of the present disclosure.
Figure 2:
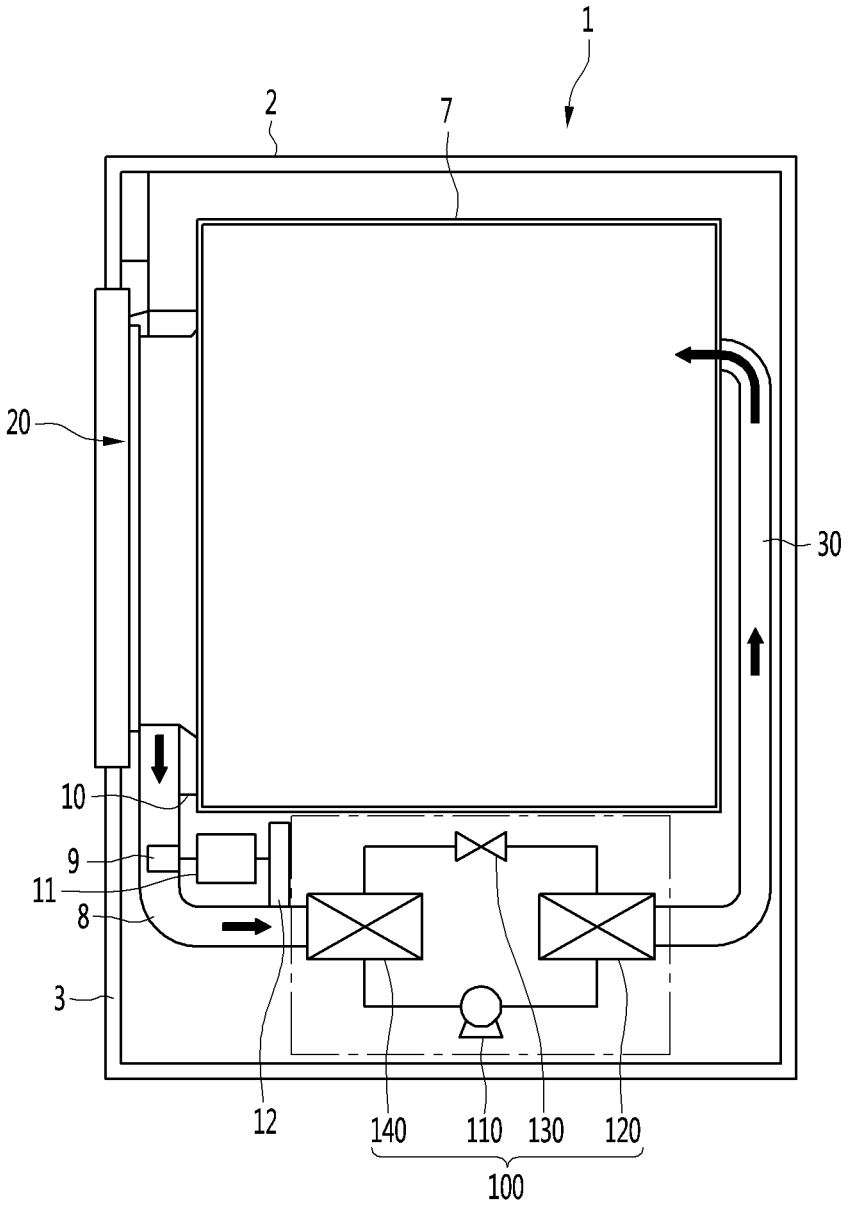
FIG. 2 is a side cross-sectional view of the laundry treating apparatus.

FIG. 1 is a perspective view of a laundry treating apparatus equipped with a door fastening structure according to an embodiment of the present disclosure. FIG. 2 is a side cross-sectional view of the laundry treating apparatus.

Referring to FIGS. 1 and 2, the laundry treating apparatus 1 according to the embodiment of the present disclosure may include a cabinet 2, a drying drum 7 provided inside the cabinet 2, a front cover 3 mounted on a front surface of the cabinet and having an opening 3*a* (or a laundry receiving hole) defined therein for laundry input thereinto, and a door 20 pivotally mounted on the front cover 3 for opening and closing the opening 3*a*.

Further, the drying machine may include: a control panel 4 mounted on the top of the front cover 3: and a drawer 13 mounted on the side of the control panel 4 for storing therein condensed water. The control panel 4 may include a manipulator 6 for inputting various driving instructions, including a power supply button, and a display 5 for indicating the driving state of the drying machine.

In one example, the interior of the cabinet 2 is equipped with a circulation duct 8, through which hot and dry air is introduced into the drying drum 7 and through which hot and humid air inside the drying drum 7 is discharged to the outside of the drying drum. Subsequently, a heat-pump assembly 100 is provided on the air passage defined by the circulation duct 3.

Specifically, the inlet end of the circulation duct 8 may be defined between a rear surface of the front cover 3 and a front surface of the drying drum 7. The lint filter 10 is mounted inside the inlet end of the circulation duct 8. Further, the lint contained in the humid air, which is discharged through the opening in the front surface of the drying drum 7 may be filtered by the lint filter 10.

Further, the circulation duct 8 extends along the space between the bottom of the drying drum 7 and the bottom of the cabinet 2 and extends to the rear surface of the drying drum 7. Furthermore, the outlet end of the circulation duct 8 is connected to the rear surface of the drying drum 7.

Further, a circulation fan 9 is mounted inside the circulation duct 8. Via the driving of the fan, the hot and dry air and the hot and humid air circulate along the drying drum 7 and the circulation duct 8.

Further, the circulation fan 9 is connected to the rotating shaft of the drive motor 11. The rotating shaft of the drive motor 11 is connected to a power transmission 12 for rotating the drying drum 7. Further, the power transmission 12 includes: a pulley connected to the rotating shaft of the drive motor 11; and a belt surrounding the pulley and the outer circumferential surface of the drying drum 7. Alternatively, the power transmission 12 may include a roller connected to the rotating shaft of the drive motor 11 and in contact with the outer circumferential surface of the drying drum 7.

In one example, the heat pump assembly 100 may be provided on the circulation passage defined by the circulation duct 8. In detail, the heat pump assembly 100 includes: a compressor 110 that compresses a refrigerant into a high-temperature, high-pressure gas; a condenser 120 for condensing the refrigerant having passed through the compressor 110 into a high-temperature and high-pressure liquid; an expansion valve 130 for changing the refrigerant having passed through the condenser 120 to a low-temperature low-pressure two-phase refrigerant; and an evaporator 140 which evaporates the two-phase refrigerant having passed through the expansion valve to a low-temperature, low-pressure vapor refrigerant.

In detail, the hot and humid air that has passed through the lint filter 10 generates condensed water while passing through the evaporator 140, and then changes into a low-temperature dried air. Subsequently, the condensed water produced on the surface of the evaporator 140 is collected and then sent to the drawer 13 by a drain pump.

Subsequently, the low temperature dry air that has passed through the evaporator 140 is converted into hot dry air through the condenser 120. Subsequently, the hot and dry air that has passed through the condenser 120 flows into the drying drum 7 through the rear surface of the drying drum 7.

Subsequently, the hot and dry air introduced into the drying drum 7 dries the wet laundry in the drying drum 7 and then changes to a high temperature and high humidity state. In this connection, the drying drum 7 alternately repeats forward and reverse rotations at the set speed.

In this way, the rotation of the drying drum 7, the operation of the heat pump system 100, and the circulation of air allow the laundry laid into the drying drum 7 to be dried.

In one example, depending on the location of the laundry treating apparatus 1, such as the drying machine, one of the left or right sides of the cabinet 2 may be in a close contact with the wall of the laundry room. Thus, depending on the installation location of the laundry treating apparatus 1, the hinge assembly is mounted on one of the left edge and the right edge of the door 20 while a latch or door latch is mounted on the other.

In this connection, when the mounting position of the hinge assembly and door latch is fixed to either the left edge or the right edge of the door, two types of doors must be designed and produced. Therefore, in order to remedy such inconvenience and productivity deterioration, a door structure according to the embodiment of the present disclosure is presented.

Figure 3:
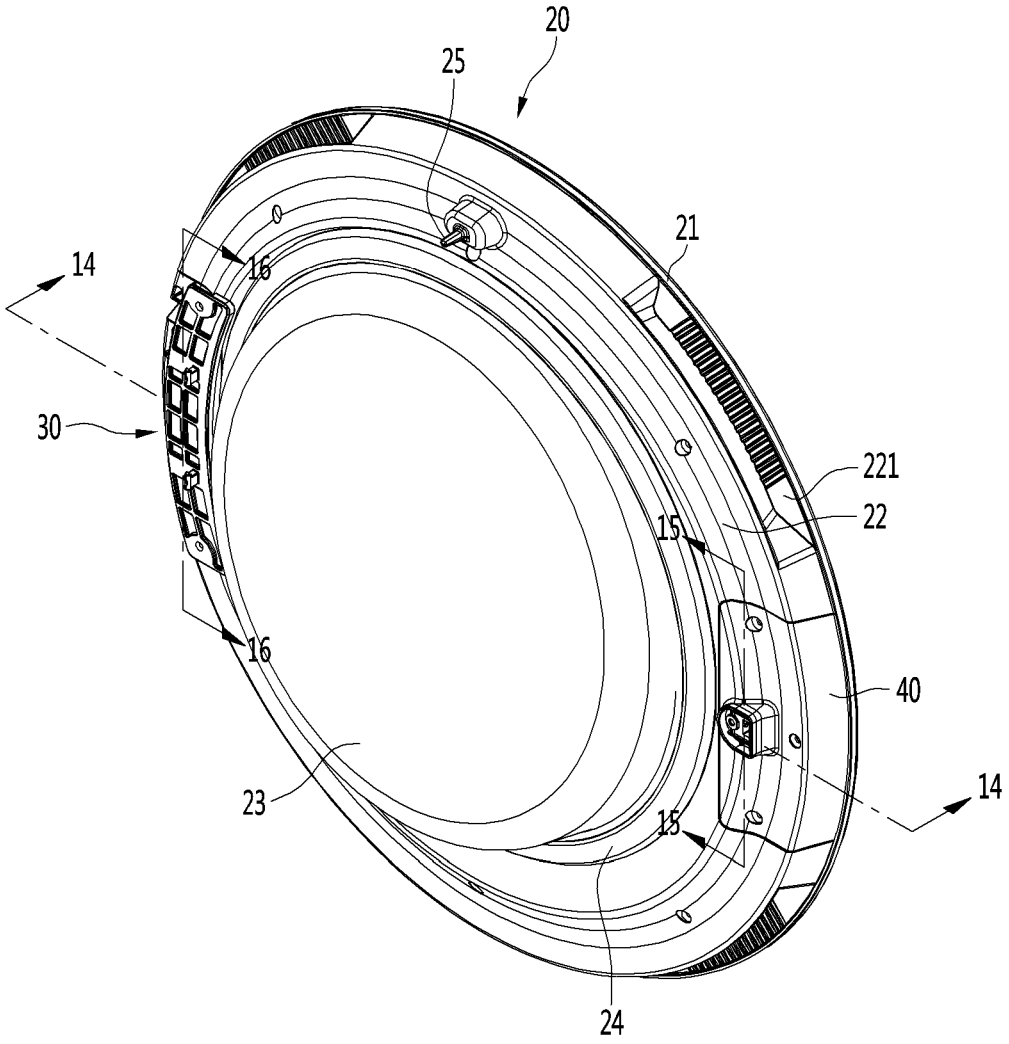
FIG. 3 is a rear perspective view of the door that constitutes the laundry treating apparatus according to the embodiment of the present disclosure.
Figure 4:
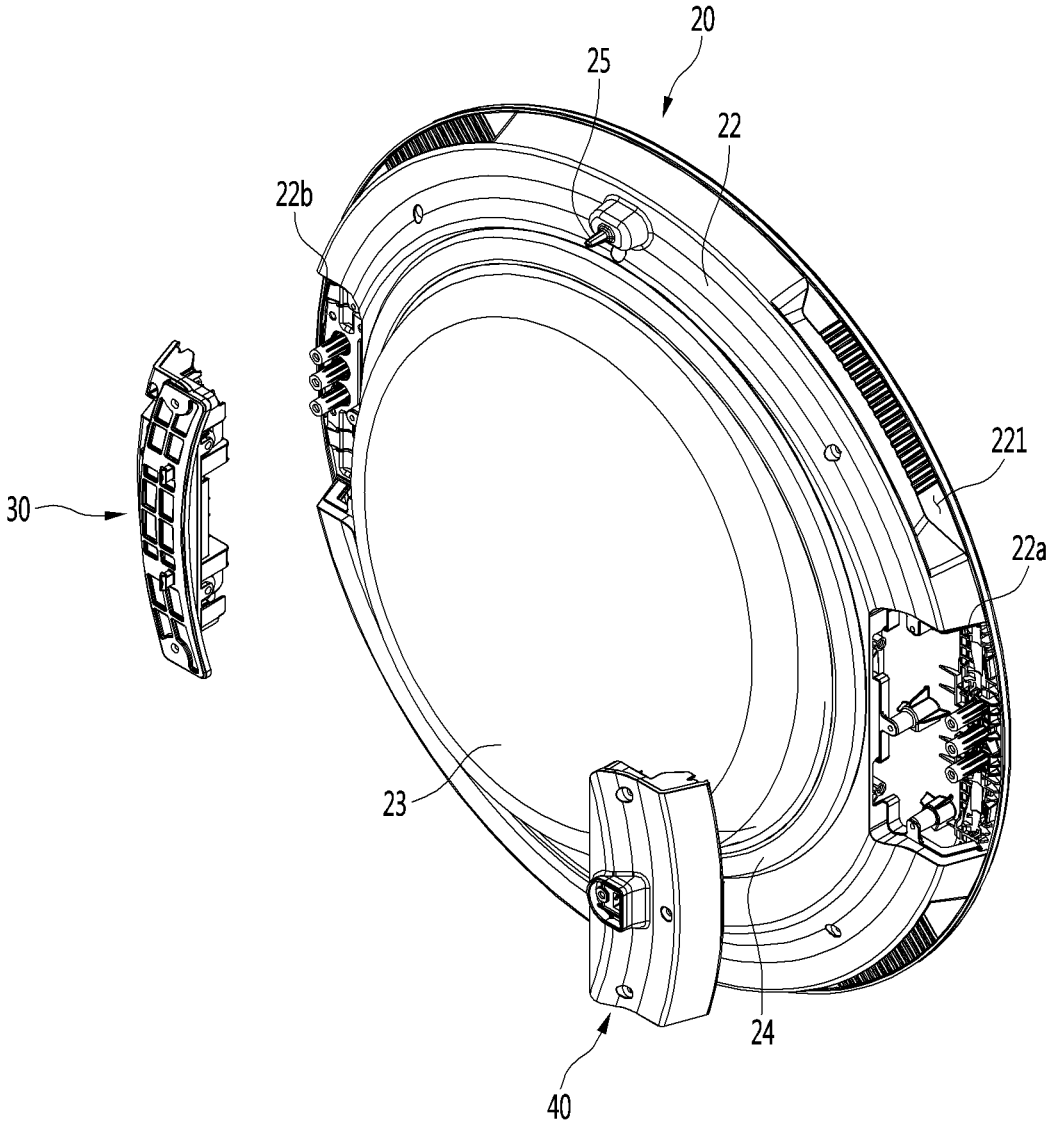
FIG. 4 is an exploded perspective view of the door.

FIG. 3 is a rear perspective view of a door that constitutes the laundry treating apparatus according to the embodiment of the present disclosure. FIG. 4 is an exploded perspective view of the door.

Referring to FIGS. 3 and 4, the door 20 of the laundry treating apparatus 1 according to the embodiment of the present disclosure includes a door cover 21 defining a front surface portion and a door frame 22 mounted on the rear surface of the door cover 21, a door glass 23 mounted in a hole defined inside the door frame, a sealing member 24 surrounding the edge of the door glass 23, a hinge assembly 30 mounted on one of the left edge and the right edge of the door frame 22, and a latch assembly mounted on the other of the left edge and right edge of the door frame 22.

The door cover 21 may be made of transparent or opaque glass or plastic. Further, the door frame 22 may be made of a plastic material having a predetermined strength. Furthermore, the sealing member 24 may be made of rubber or silicone material. Further, the door glass 23 may be made of a transparent glass material or a transparent plastic material.

In particular, the latch assembly may include a latch cover 40 secured to the door frame 22 and a latch (not shown) projecting from the latch cover 40. Further, when the door 20 is closed, the latch is inserted and fixed in a latch housing defined in the front surface of the laundry treating apparatus 1. The latch housing is formed at the outer edge of an opening 3*a* defined in the front cover 3.

In the left edge and the right edge of the door frame 22, a left cover seating portion 22*a* and a right cover seating portion 22*b* are respectively defined. In this connection, the left cover seating portion 22*a* and the right cover seating portion 22*b* may be defined at the left edge and right edge of the door 20, respectively, in a state facing the front surface of the door 20.

Further, the left cover seating portion 22*a* and the right cover seating portion 22*b* are shaped symmetrically with respect to a vertical line passing through the center of the door 20. The left cover seating portion 22*a* and the right cover seating portion 22*b* are shaped symmetrically with respect to a horizontal line passing through the center of the door 20. Accordingly, when one of the hinge assembly 30 and the latch cover 40 mounted on one of the left cover seating portion 22*a* and the right cover seating portion 22*b* is rotated clockwise or counterclockwise 180 degrees, the other of the hinge assembly 30 and the latch cover 40 may be correctly mounted on the other of the left cover seating portion 22*a* and the right cover seating portion 22*b*.

In one example, a door switch 25 protrudes on the rear surface edge of the door frame 22. When the door 20 is closed, the door switch 25 turns on or off a switch formed on the front cover 3. Thus, the door being closed may be detected.

Further, in the side face portion of the door frame 22, that is, the circumferential surface of the door 20, one or a plurality of gripped grooves 221 may be defined to be recessed to a predetermined depth. Specifically, a position of the gripped groove 221 may be determined by one of the left edge and the right edge of the door which the hinge assembly 30 is coupled to. Thus, at least two gripped grooves 221 may be defined, respectively, at locations symmetrically with respect to the vertical line passing through the center of the door 20.

Hereinafter, the structure of the latch cover 40 constituting the latch assembly and the structure of the hinge assembly 30 will be described in more detail with reference to the drawings.

Figure 5:
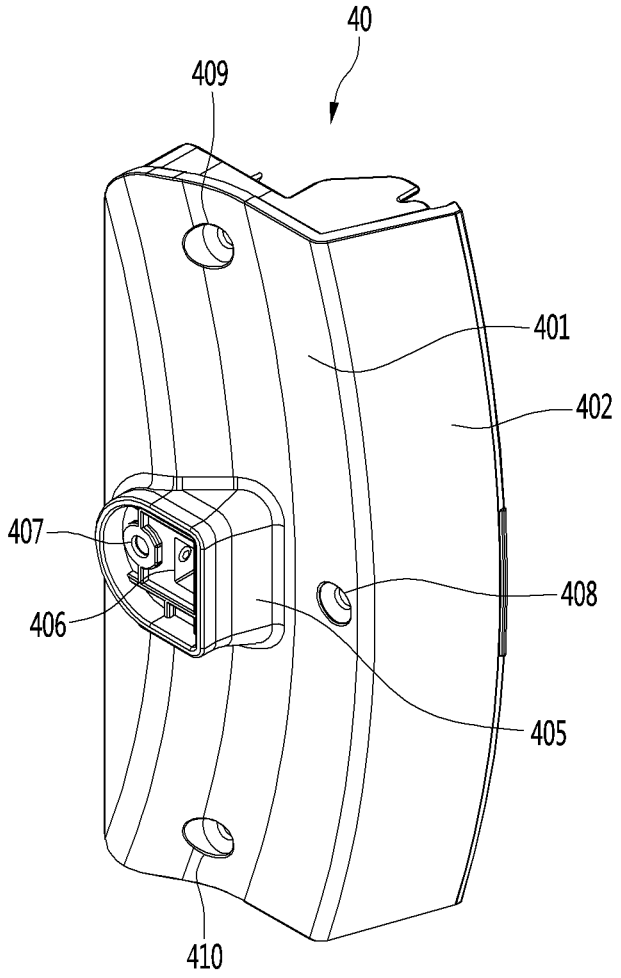
FIG. 5 shows a front perspective view of the latch cover mounted on the door according to the embodiment of the present disclosure.
Figure 6:
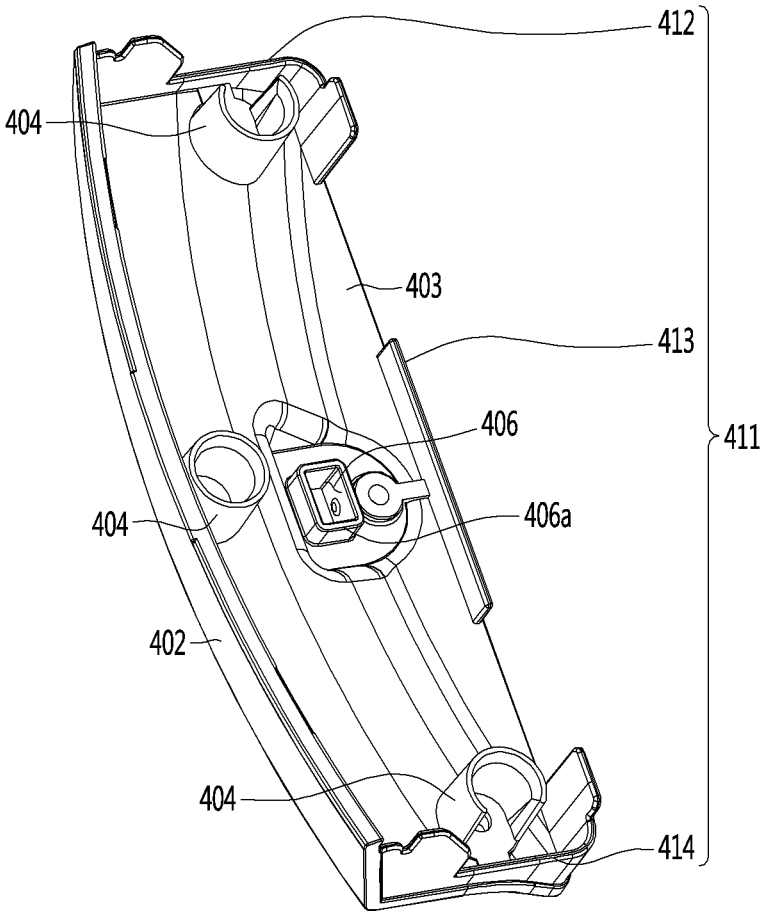
FIG. 6 is a rear perspective view of the latch cover.

FIG. 5 is a front perspective view of a latch cover mounted on a door according to an embodiment of the present disclosure. FIG. 6 is a rear perspective view of the latch cover.

Referring to FIGS. 5 and 6, the latch cover 40 according to the embodiment of the present disclosure has the same contour shape as the cut shape of the corresponding one of the cover seating portions 20*a* and 20*b*. The latch cover completely screens the left cover seating portion 20*a* or the right cover seating portion 20*b*. In particular, the latch cover 40 includes a front surface portion 401 that defines a portion of the rear surface of the door frame 22, a side bent portion 402 bent from the outer edge (a right edge in FIG. 5) of the front surface portion 401 and defining a part of the side face of the door frame 22, and a rear surface portion 403 defining an opposite surface to the front surface portion 401.

Further, the latch cover 40 is shaped to be symmetrical with respect to a horizontal line bisecting the latch cover 40 vertically. Further, from the front surface portion 401, a sleeve-shaped latch guide 405 is projected. The latch guide 405 may be shaped to be symmetrical with respect to a vertical line bisecting the latch cover 40 vertically. Further, the latch hole 406 meets a line bisecting the latch cover 40 vertically. A hook-shaped latch (not shown) is inserted and fixed in the latch hole 406. Further, when the door 20 is closed, the latch is inserted and secured in the latch housing defined in the front surface of the cabinet 2.

Further, in the front surface portion 401, a plurality of fastening holes may be defined. The plurality of fastening holes may include an inner central hole 407 defined in the latch guide 405, an outer central hole 408 defined in the lateral edge of the front surface portion 401, an upper edge hole 409 defined in the upper edge of the front surface portion 401, and a lower edge hole 410 defined in a lower edge of the front surface portion 401. It should be noted that the number and formation positions of the plurality of fastening holes are not limited to the embodiment as shown.

Further, the inner central hole 407, the latch hole 406, and the outer central hole 408 may be positioned on a horizontal line that bisects the latch cover 40 vertically.

Further, the upper edge hole 409 and the lower edge hole 410 may be defined at the same distance from the center of the door 20, but the present disclosure is not limited thereto.

Further, along the edge of the latch hole 406, the latch sleeve 406*a* projects from the rear surface portion 403. The latch sleeve may also guide the insertion of the latch. Further, the guide sleeves 404 may extend from the rear surface portion 403 corresponding to the edges of the plurality of fastening holes 407, 408, 409 and 410, respectively.

Further, from the edge of the latch cover 40, the mount ribs may extend backward (in a direction from the front surface portion 401 to the rear surface portion 403) by a predetermined length. In particular, the mount ribs may include an upper mount rib 412, a side mount rib 413, and a lower mount rib 414.

More specifically, the upper mount rib 412 may extend from the upper edges of the front surface portion 401 and the side bent portion 402 to the upper portion of the inner edge of the front surface portion. In this connection, the inner edge of the front surface portion means an edge opposite the side face edge at which the side bent portion 402 is formed, or the left edge in the drawing.

Further, the side mount ribs 413 may extend a predetermined length from the inner edge of the front surface portion 401.

Further, the lower mount rib 413 may extend in a shape symmetrical with the upper mount rib 412. That is, the lower mount ribs 413 may extend from the lower edges of the front surface portion 401 and the side bent portion 402 to the lower portion of the inner edge of the front surface portion 401. Thus, when the latch cover 40 is mounted on one of the left edge and the right edge of the rear surface of the door, the top and bottom of the latch cover 40 are switched according to the mounting position. Thus, regardless of whether the latch cover is coupled to either the right edge or the left edge, the engagement of the latch cover is smoothly achieved.

In this connection, it is noted that the upper mount rib 412 and the side mount rib 413 and the lower mount rib 414 may be connected via a single sleeve. That is, the mount rib may extend continuously along the edge of the latch cover 40.

Figure 7:
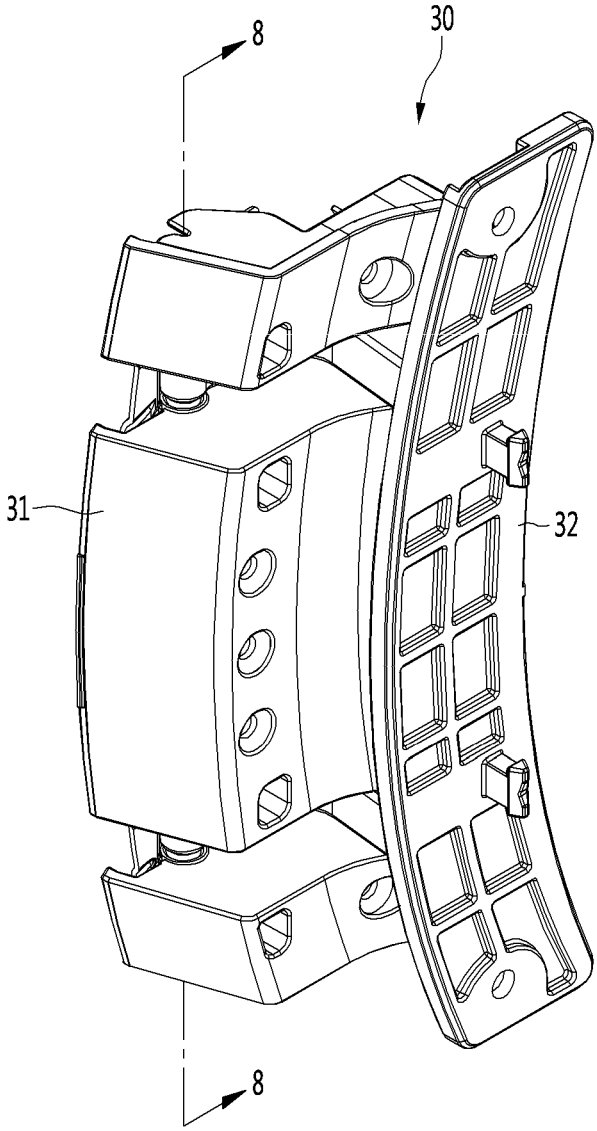
FIG. 7 is a perspective view of a hinge assembly mounted on a door according to an embodiment of the present disclosure.
Figure 8:
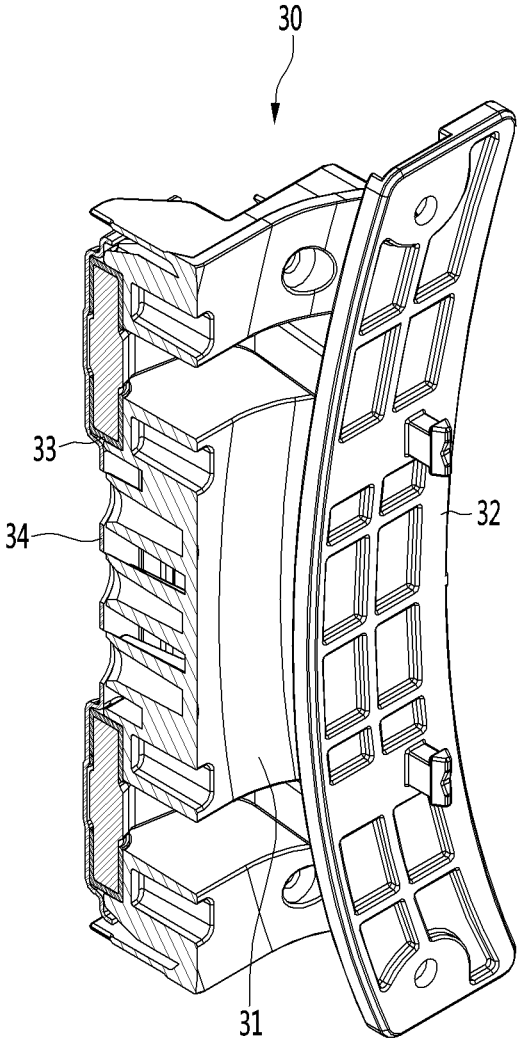
FIG. 8 is a cutaway perspective view taken along a line 8-8 of FIG. 7.
Figure 9:
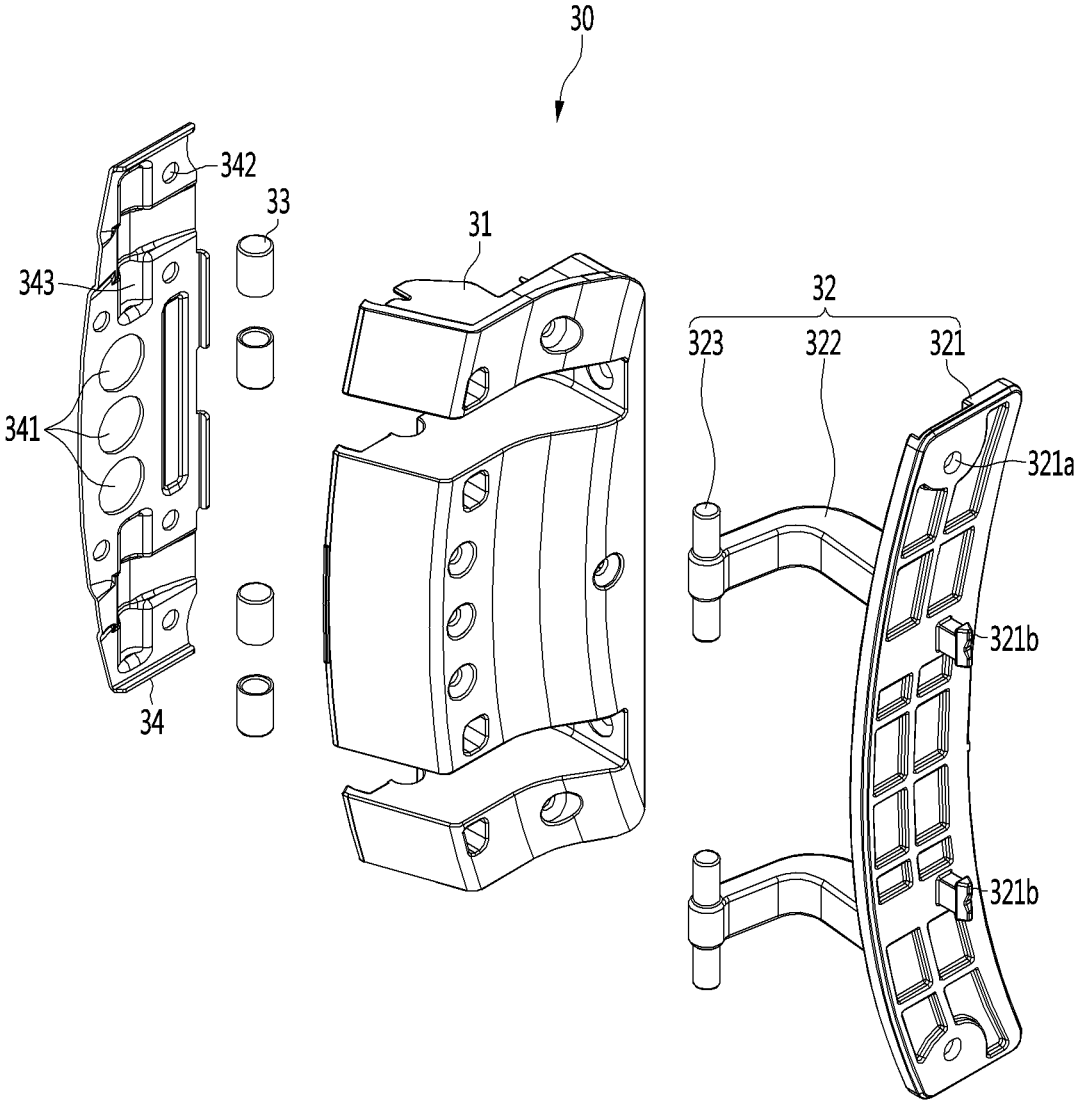
FIG. 9 is an exploded perspective view of the hinge assembly.

FIG. 7 is a perspective view of a hinge assembly mounted on a door according to an embodiment of the present disclosure. FIG. 8 is a cutaway perspective view taken along a line 8-8 of FIG. 7. FIG. 9 is an exploded perspective view of the hinge assembly.

Referring to FIGS. 7 to 9, a hinge assembly 30 according to an embodiment of the present disclosure includes a hinge base 34 seated on a cover seating portion of the door frame 20, a hinge cover 31 seated and engaged on the hinge base 34, a hinge body 32 pivotally coupled to the hinge cover 31, and a hinge bearing 33 coupled to the hinge body 32. The hinge assembly 30 is fabricated in a single module form. The hinge assembly may be secured to the rear surface of the door frame 22 and to the front cover 3.

In detail, the hinge base 34 may include a metal plate. In the hinge base, a plurality of boss holes 341 and fastening holes 342 and bearing seating grooves 343 may be defined.

Further, the hinge body 32 may include a hinge head 321 having a rear surface that is in close contact with the left or right edge of the opening 3*a* (see FIG. 1), at least one hinge leg 322 extending from a front surface of the hinge head 321, and a hinge shaft 323 extending from a distal end of the at least one hinge leg 322.

Upper and lower hinge legs 322 may be respectively formed at the upper and lower portions of the hinge head 321 to stably bear the load of the door 20. The hinge leg 322 may be constructed to be bent at a predetermined angle to increase the amount of rotation of the door 20.

Further, the hinge shaft 323 may extend in a direction perpendicular to the extending direction of the hinge leg 322. That is, the hinge shaft 323 may extend in up and down directions from the distal end of the hinge leg 322, respectively.

Further, the hinge bearing 33 is fitted on the outer circumferential surface of the hinge shaft 323. This may allow the hinge body 32 to rotate smoothly. Further, the hinge bearing 33 may be seated in the bearing seating groove 343 defined within the hinge base 34.

In each of the top edge and bottom edge of the hinge head 321, a fastening hole 321*a* is defined. A plurality of fixing hooks 321*b* may protrude from the rear surface of the hinge head 321. The fixing hook 321*b* penetrates through the inner edge of the opening 3*a* of the front cover 3 and inserts into the opening. A fastening member may pass from the front surface of the hinge head 321 and then through the fastening hole 321*a* and then coupled to the front cover 3.

In this connection, a tub cover is attached to the rear surface of the front cover 3, though not shown. Further, a fastening bushing may be provided between the front cover and the tub cover. In this way, the tub cover may be secured and coupled to the front cover.

Further, a fastening bracket (which may be the same or similar metal plate as the hinge head) may be in close contact with the rear surface of the tub cover. The fixing hook 321*b* may pass through the front cover and the tub cover and then fit within a hole defined within the fastening bracket.

Further, a fastening member passing through the fastening hole 321*a* may pass through the front cover and the fastening bushing and then be coupled to the tub cover. Using the aforementioned fastening structure, the load of the door delivered to the hinge assembly 30 may be dispersed to the front cover 3 and the tub cover. As a result, the shape deformation of the front cover 3 may be minimized.

The details of the structure of the hinge cover 31 will be described below with reference to the drawings.

Figure 10:
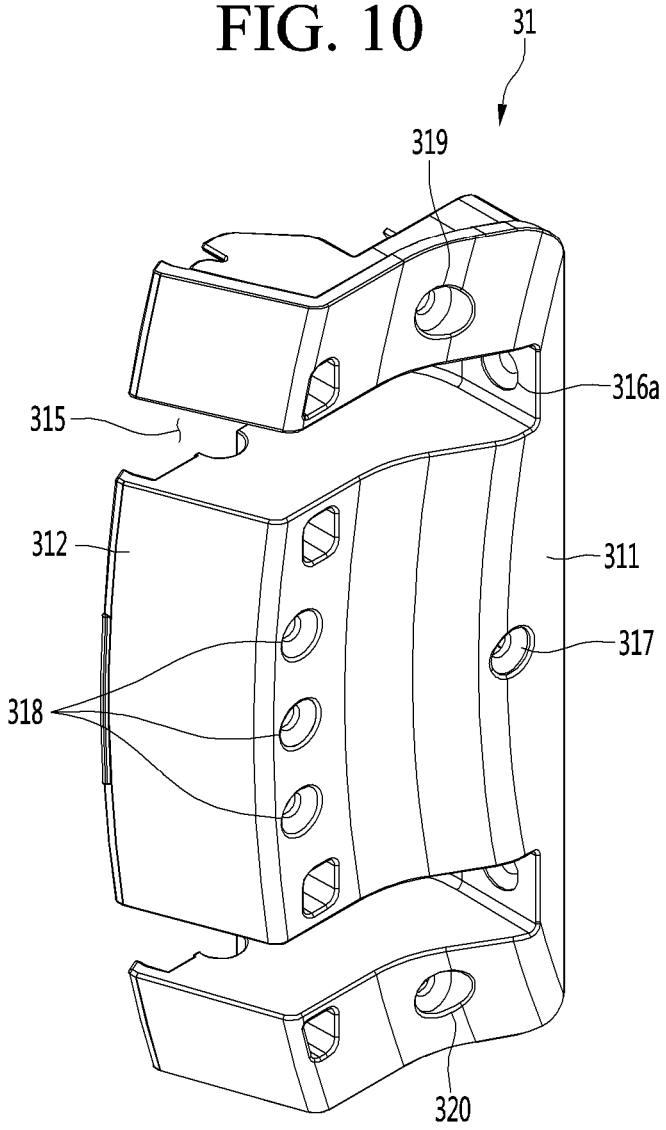
FIG. 10 is a front perspective view of the hinge cover that constitutes the hinge assembly according to the embodiment of the present disclosure
Figure 11:
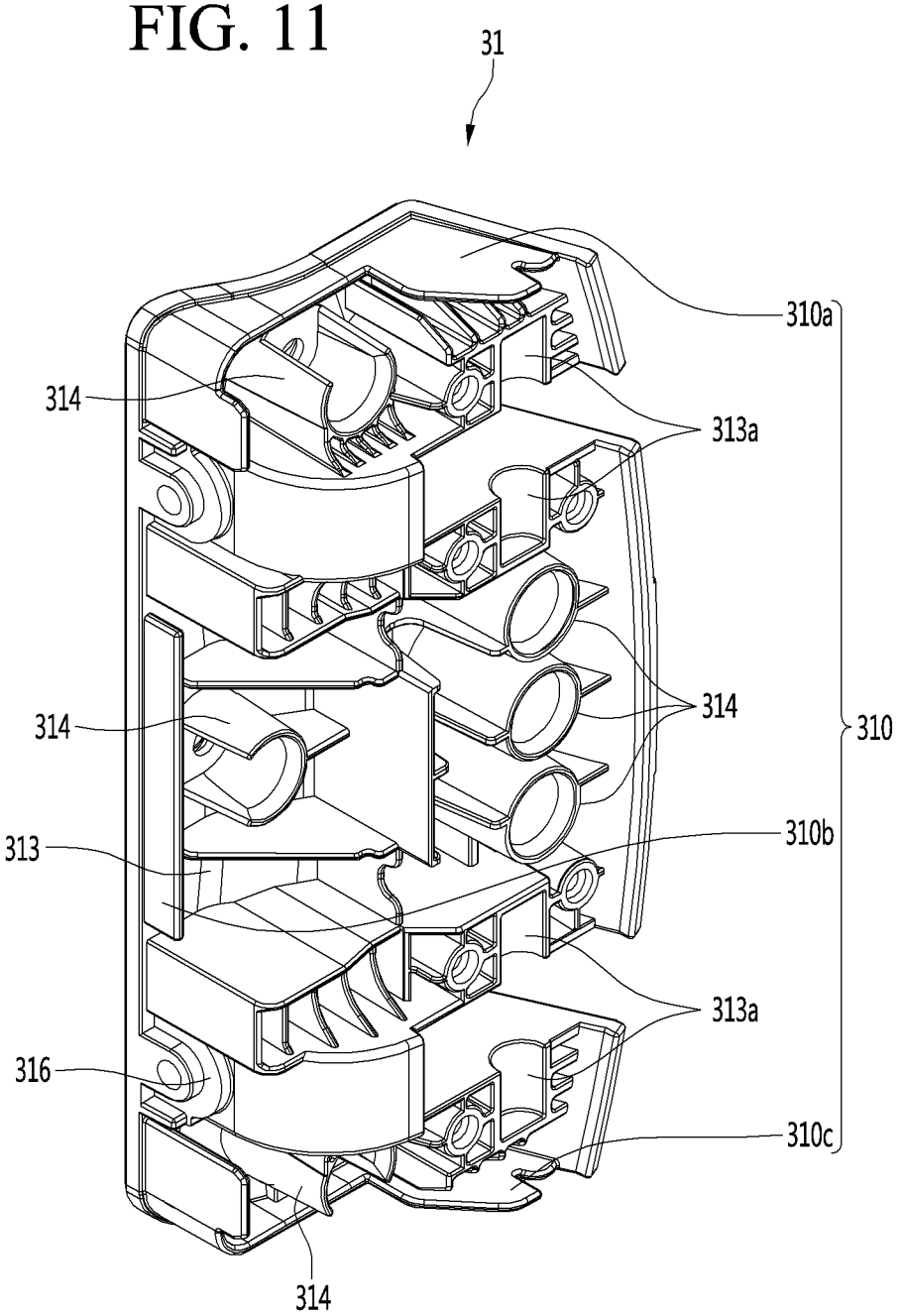
FIG. 11 is a rear perspective view of the hinge cover.

FIG. 10 is a front perspective view of the hinge cover that constitutes the hinge assembly according to the embodiment of the present disclosure. FIG. 11 is a rear perspective view of the hinge cover.

Referring to FIG. 10 and FIG. 11, the hinge cover 31 has a similar configuration to the latch cover 40. The hinge cover 31 may include a front surface portion 311 that defines a portion of the rear surface of the door frame 22, a side bent portion 312 bent rearward from an outer edge (left edge in FIG. 10) of the front surface portion 311 and defining an outer circumferential surface of the door frame 22, that is, a part of the circumferential surface of the door 20, and the rear surface portion 313 opposite the front surface portion 311.

Further, the contour line or contour profile defining the front surface portion 311 and side bent portion 312 of the hinge cover 31 may be identical with the contour line or contour profile defining the latch cover 40.

In detail, the contour profile of the front surface portion 311 and the side bent portion 313 of the hinge cover 31 and the contour profile of the front surface portion 401 and the side bent portion 402 of the latch cover 40 are symmetrically shaped with respect to the vertical line.

Further, the hinge cover 31 may be symmetrically shaped with respect to the horizontal line bisecting the hinge cover 31 vertically such that the hinge cover 31 may be mounted on either the rear surface left or right edge of the door. This configuration may be equally applied to the latch cover 40 as has already been described.

More specifically, in the hinge cover 31, a leg housing 315 for receiving the hinge leg 322 is recessed. In this embodiment, a pair of leg housings 315 are defined to correspond to the pair of hinge legs 322. This is merely exemplary. The pair of leg housings 315 may be defined at locations that are symmetrical to each other vertically with respect to a horizontal line bisecting the hinge cover 31 vertically.

Further, in the front surface portion 311, a plurality of fastening holes may be defined. The plurality of fastening holes may include an inner central hole 317, an outer central hole 318, an upper edge hole 319, and a lower edge hole 320.

In this connection, positions at which the inner central hole 317, the outer central hole 318, the upper edge hole 319 and the lower edge hole 320 are defined in the front surface portion 311 may be identical with positions at which the inner central hole 407, the outer central hole 408, the upper edge hole 409, and the lower edge hole 410 are defined in the front surface portion 401 of the latch cover 40. However, since the hinge assembly 30 must withstand the load of the door, the hinge cover 31 may have a plurality of outer central holes 318 defined therein. One of the plurality of outer central holes 318 may be essentially defined at a location corresponding to the location of the outer central hole 408 of the latch cover 40.

For example, the outer central hole of the hinge cover 31 corresponding to the outer central hole 408 of the latch cover 40 may be defined as a first outer central hole. The second and third outer central holes may be defined below and above the first outer central hole, respectively. Further, the second outer central hole and the third outer central hole may be defined at symmetrical points with respect to the first outer central hole.

Further, as with the latch cover 40, the inner central hole 317 and the first outer central hole may be positioned on a horizontal line bisecting the hinge cover 31 vertically.

Further, the distances from the center of the door 20 to all of the plurality of outer central holes 318 may be the same. That is, the outer central holes 318 may lie on the same circumference.

Further, the upper edge hole 319 and the lower edge hole 320 may be defined at positions symmetrical with respect to a horizontal line bisecting the hinge cover 31 vertically. The upper edge hole 319 and the lower edge hole 320 may be positioned on the same circumference.

In one example, a side edge hole 316*a* may additionally be defined in the hinge cover 31 to allow the hinge assembly 30 to withstand the load of the door stably. In particular, the side edge holes 316*a* may be defined at the inner distal end of the leg housing 315. The insertion direction of the fastening member inserted into the side edge hole 316*a* may be orthogonal to the insertion direction of the fastening member inserted into the other fastening holes 317 to 320.

That is, a fastening member inserted into the side edge hole 316*a* may be inserted toward the center of the door 20, while fastening members inserted into the other fastening holes 317 to 320 may be inserted in the thickness direction of the door.

Further, guide sleeves 314 may extend from points of the rear surface portion 313 corresponding to edges of a plurality of fastening holes 317 to 320, respectively. Further, a side edge rib 316 extends from the rear surface portion 313 defining the rear surface of the side fastening hole 316*a*. As such, a fastening member may pass through the side edge rib 316.

Further, bearing seating groove 313*a* may be defined at the point of the rear surface portion 313 of the hinge cover 31 corresponding to the bearing seating groove 343 of the hinge base 34 when the hinge cover 31 is coupled to the hinge base 34. Then, as shown in FIG. 8, the hinge bearing 33 may be received in the space defined by the bearing seating grooves 343 and 313*a*.

Further, on the edge of the hinge cover 31, a mount rib 310 having the same shape as the mount rib 411 of the latch cover 40 is formed. That is, the mount rib 310 may include an upper mount rib 310*a*, a side mount rib 310*b*, and a lower mount rib 310*c*.

Further, the shape and position of the mount rib 310 formed on the hinge cover 31 is the same as the shape and position of the mount rib 411 defined on the latch cover 40. This is because the hinge cover 31 must be equally mountable in the cover seating portion on which the latch cover 40 is mounted.

Figure 12:
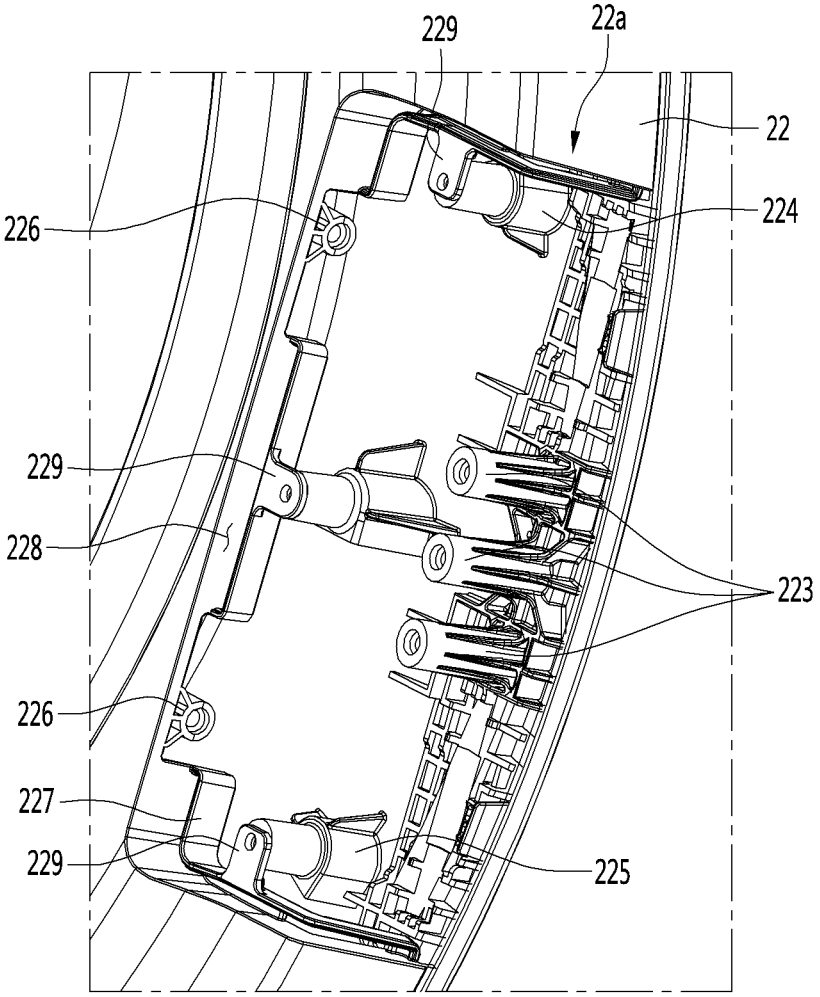
FIG. 12 is an enlarged view of a left cover seating portion defined in the door frame according to the embodiment of the present disclosure.
Figure 13:
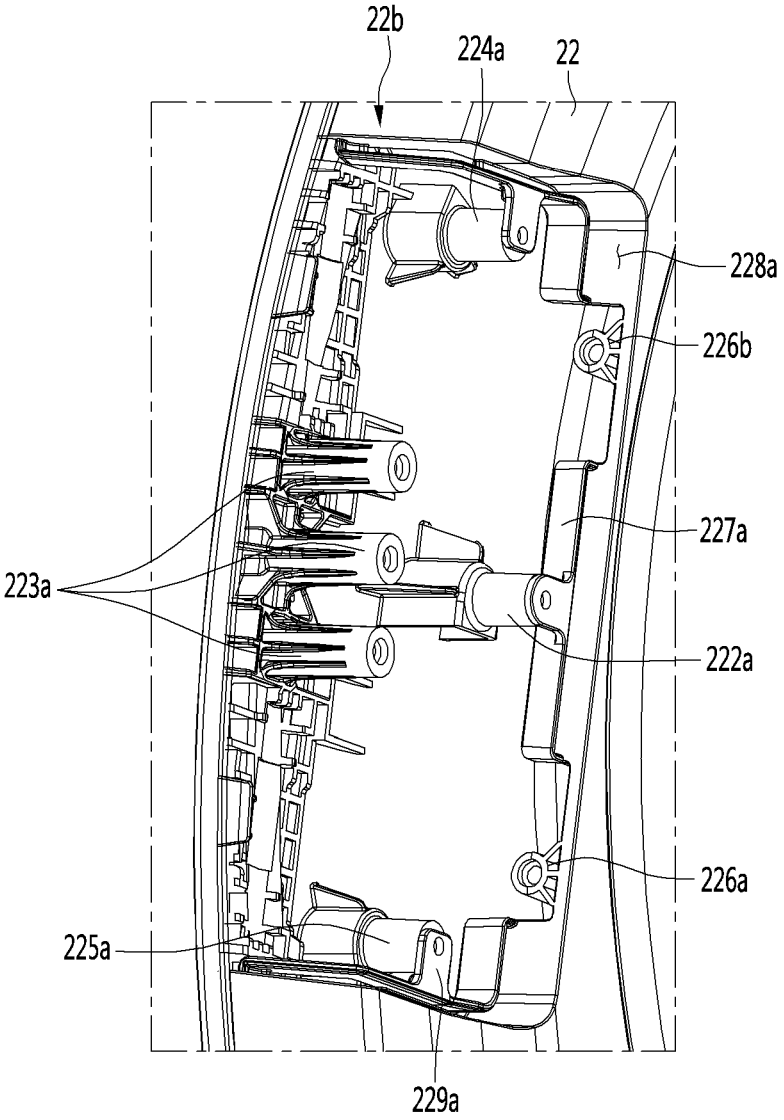
FIG. 13 is an enlarged view of a right cover seating portion defined in the door frame.

FIG. 12 is an enlarged view of the left cover seating portion defined in the door frame according to the embodiment of the present disclosure. FIG. 13 is an enlarged view of the right cover seating portion defined in the door frame according to the embodiment of the present disclosure.

Referring to FIGS. 12 and 13, the left and right cover seating portions 22*a* and 22*b* are symmetrical with respect to the vertical line in terms of size, shape, and internal structure. That is, the left cover seating portion 22*a* and the right cover seating portion 22*b* are defined to be symmetrical with respect to a horizontal line bisecting the cover seating portions vertically. Thus, even when either the hinge cover 31 or the latch cover 40 is mounted on either the left cover seating portion 22*a* or the right cover seating portion 22*b*, the accurate mounting therebetween may be achieved.

Further, a horizontal line bisecting the cover seating portions vertically may be configured to pass through the center of the door 20.

Hereinafter, the left cover seating portion 22*a* will be mainly described. Thus, the overlapping description of the structure between the right cover seating portion 22*b* and the left cover seating portion 22*a* will be omitted.

The left cover seating portion 22*a* may be defined by a portion of the door frame 22 being recessed forwardly (toward the door cover) by a predetermined depth. Further, at the inner side of the left cover seating portion 22*a*, an inner side rib 227 may extend on the left cover seating portion 22*a*. The inner side rib 227 may extend continuously from the point spaced apart from the edge of the left cover seating portion 22*a* by a predetermined distance along the edge of the left cover seating portion 22*a*.

Further, the space defined between the edge of the left cover seating portion 22*a* and the inner side rib 227 may be defined as a mount rib receiving groove 228. That is, into the mount rib receiving groove 228, the mount rib 411 of the latch cover 40 or the mount rib 310 of the hinge cover 31 is inserted.

Specifically, when the mount rib 310 is fitted into the mount rib receiving groove 228, some of the load of the door delivered to the hinge cover 31 may be dispersed to the door frame 22. As a result, the possibility of sagging of the door due to the fact that the load of the door 20 is concentrated on the hinge body 32 may be minimized. This reduces the possibility of door breakage.

Further, a plurality of fastening bosses may extend from the bottom of the left cover seating portion 22*a*. The plurality of fastening bosses may include an upper edge boss 224, an inner central boss 222, an outer central boss 223, and a lower edge boss 225.

The upper edge boss 224 extends from the upper edge of the left cover seating portion 22*a* to a rear of the door 20.

The inner central boss 222 extends from the inner side face edge of the left cover seating portion 22*a* to a rear of the door 20.

The outer central boss 223 extends from the outer side face edge of the left cover seating portion 22*a* (corresponding to the outer edge of the door) to a rear of the door 20

The lower edge boss 225 extends from the lower edge of the left cover seating portion 22*a* to a rear of the door 20.

A plurality of the outer central bosses 223 may be defined. The plurality of outer central bosses 223 correspond to the outer central holes 318 of the hinge cover 31. The middle boss of the plurality of outer central bosses 223 corresponds to the outer central hole 408 of the latch cover 40.

Further, fastening ribs 229 extend from the portions of the inner side rib 227 defining the top and bottom and lateral ends of the left cover seating portion 22*a*, respectively. In the fastening rib 229, a fastening hole is defined. The fastening ribs 229 formed on the inner side ribs 227 extend toward the center of the left cover seating portion 22*a*. The fastening ribs 229 then abut tops of the upper edge boss 224, the inner central boss 222 and the lower edge boss 225. That is, the fastening holes defined in the fastening ribs 229 are aligned with the fastening grooves defined in the bosses 222, 224, and 225, respectively. As a result, the fastening members becomes insertable into the holes and grooves.

In one example, the inner side rib 227*a* formed on the right cover seating portion 22*b* corresponds to the inner side rib 227 of the left cover seating portion 22*a*. Further, a plurality of fastening ribs 229*a* formed on the right cover seating portion 22*b* correspond to fastening ribs 229 of the left cover seating portion 22*a*.

Further, an upper edge boss 224*a*, an inner central boss 222*a*, an outer central boss 223*a*, a lower edge boss 225*a*, and a side edge boss 226*a* formed on the right cover seating portion 22*b* may correspond to an upper edge boss 224, an inner central boss 222, an outer central boss 223, a lower edge boss 225, and a side edge boss 226 formed on the left cover seating portion 22*a*.

Figure 14:
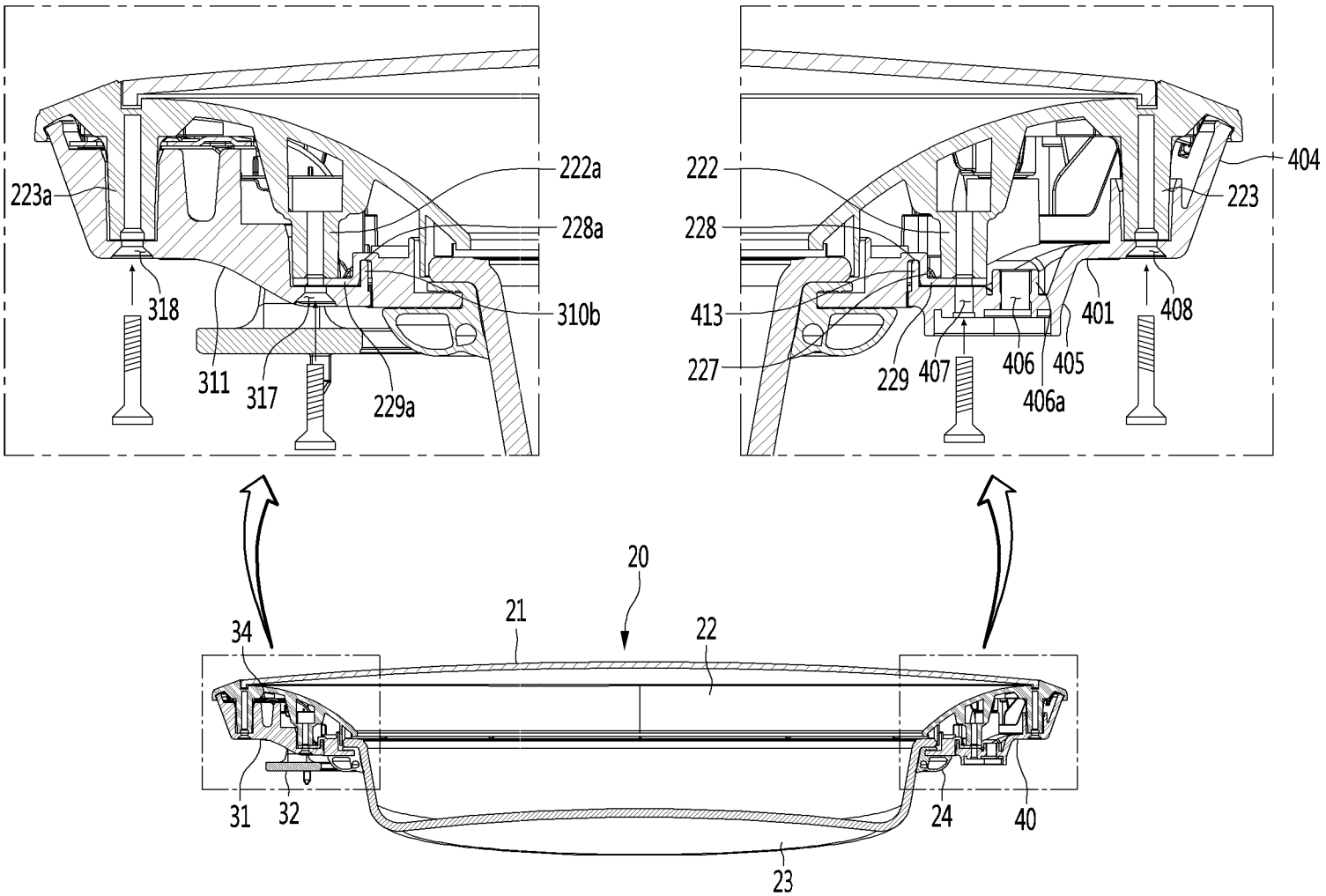
FIG. 14 is a horizontal cross-sectional view taken along a line 14-14 of FIG. 3
Figure 15:
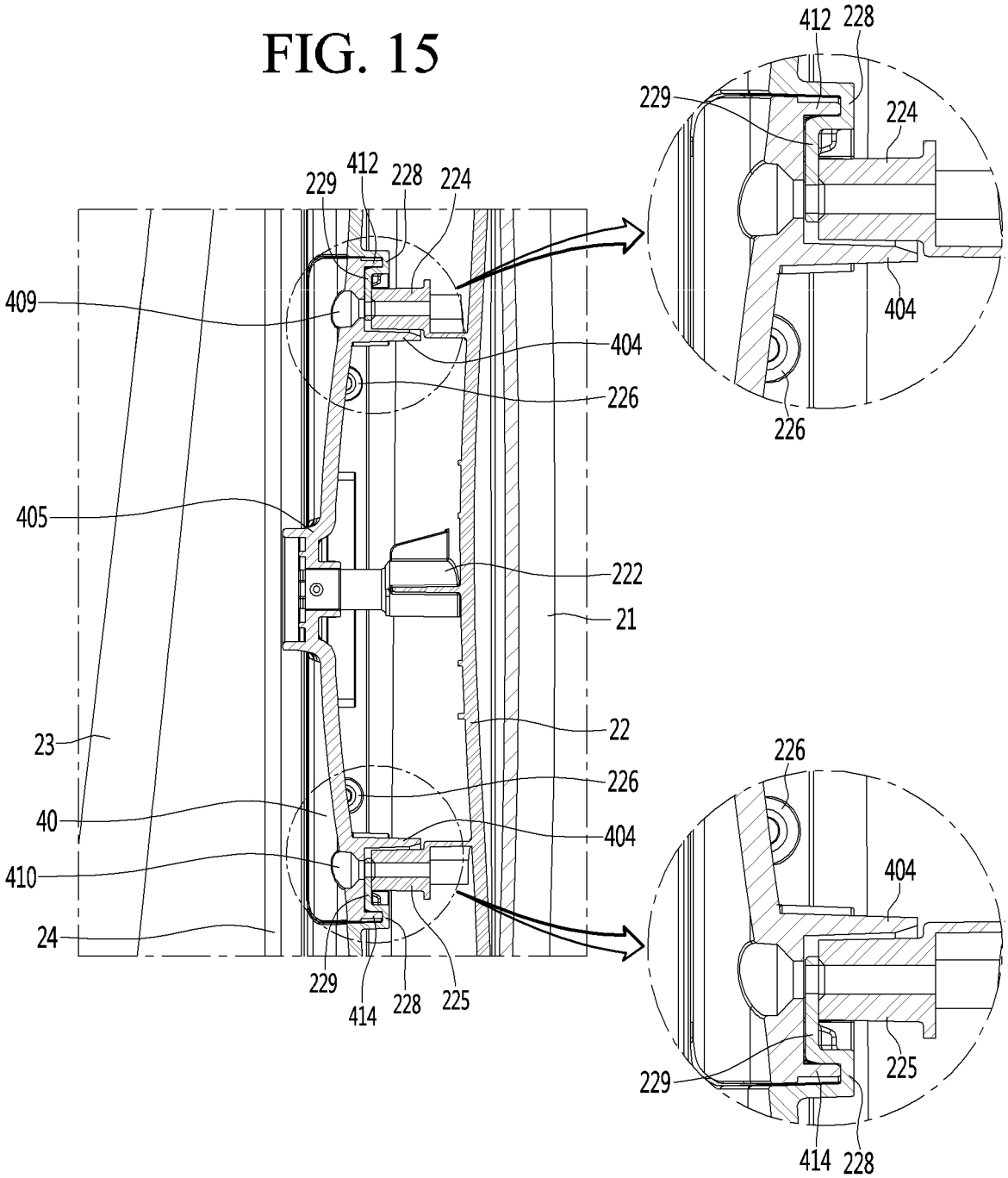
FIG. 15 is a vertical cross-sectional view taken along a line 15-15 of FIG. 3.
Figure 16:
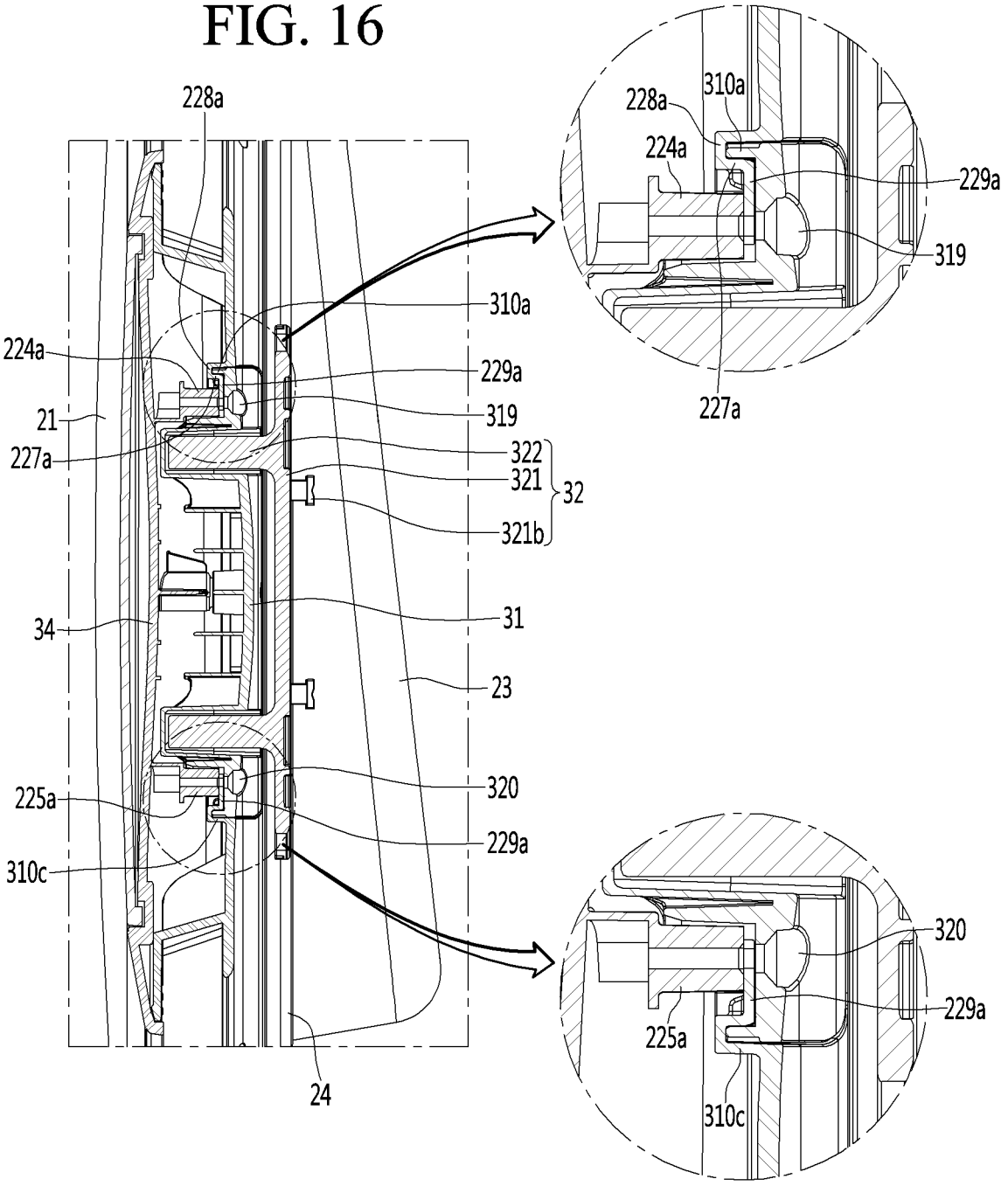
FIG. 16 is a vertical cross-sectional view taken along a line 16-16 of FIG. 3.

FIG. 14 is a cross-sectional view taken along a line 14-14 of FIG. 3. FIG. 15 is a vertical cross-sectional view taken along a line 15-15 of FIG. 3. FIG. 16 is a cross-sectional view taken along a line 16-16 of FIG. 3.

Hereinafter, the configuration in which the latch cover 40 is coupled to the left cover seating portion 22*a*, and the hinge assembly 30 is coupled to the right cover seating portion 22*b* is exemplarily adopted.

Referring to FIG. 14 to FIG. 16, when the latch cover 40 and the hinge cover 31 are seated on the left and right cover seating portions 22*a* and 22*b*, respectively, the mount ribs 411 and 310 are fitted into the mount rib receiving grooves 228 and 228*a*, respectively. Then, in the state in which the latch cover 40 and the hinge cover 31 are seated on the cover seating portions 22*a* and 22*b*, the covers are not shaken, and the load of the door concentrating on the fastening bosses may be distributed through the mount ribs.

Further, the fastening members inserted through the inner central hole, the outer central hole, the upper edge hole, and the lower edge hole pass through the fastening ribs 229 and 229*a*, and then through the inner central boss, outer central boss, upper edge boss, and lower edge boss, respectively.

Further, the fastening member inserted through the side edge hole 316*a* of the hinge cover 31 is inserted through the side edge rib 316 and then into the side edge boss 226.

In this connection, the door glass 23 protrudes convexly toward the rear of the door 20. Thus, in the state where the door 20 is open, a torsion moment may occur in the hinge body 32. In addition, due to the load of the door 20, the hinge body 32 also has a sagging moment that causes the door 20 to sag downward.

In this connection, the fastening member coupled to the upper side edge boss among a pair of side edge bosses serves to hold the side edge rib so that the side edge rib 316 are not spaced from the side edge boss due to the sagging moment.

On the other hand, the fastening member coupled to the lower side edge boss absorbs the compressive force of the side edge rib 316 pressing the side edge boss due to the sagging moment. This, in turn, prevents the side edge boss from breaking.

Further, the fastening member inserted in the fastening boss extending in the thickness direction of the door 20 may allow the twisting moment to be prevented from occurring. The sagging moment may be prevented by the fastening member inserted in the side edge boss extending radially from the center of the door 20. That is, the portions that bear the torsional moment and the sagging moment may be separated from each other. As a result, there is an advantage that the force acting on the fastening member is dispersed.

What is claimed is:

1. A laundry treating apparatus comprising:

a cabinet comprising a front part that defines a laundry receiving hole;

a door pivotally coupled to the front part of the cabinet and configured to open and close at least a portion of the laundry receiving hole, the door comprising a door cover that defines a front appearance of the door, and a door frame coupled to a rear surface of the door cover;

a latch assembly coupled to a rear side of the door, the latch assembly comprising a latch cover coupled to the door frame; and a hinge assembly that pivotally connects the door to the front part of the cabinet, the hinge assembly comprising a hinge base that faces a rear surface of the door frame, a hinge cover coupled to the hinge base, and a hinge body pivotally coupled to the hinge cover, wherein the door frame comprises:

a first cover seating portion located at a first lateral side of the rear surface of the door frame with respect to a vertical line that passes through the door and that bisects the door vertically, and a second cover seating portion located at a second lateral side of the rear surface of the door frame opposite to the first lateral side with respect to the vertical line, wherein the first cover seating portion and the second cover seating portion are symmetrical to each other with respect to the vertical line, wherein each of the first cover seating portion and the second cover seating portion is symmetrical with respect to a horizontal line that bisects the door horizontally, wherein each of the first cover seating portion and the second cover seating portion comprises a plurality of fastening bosses that protrude in a direction opposite to the door cover and that are configured to couple to one of the latch cover and the hinge cover, and wherein the plurality of fastening bosses comprise:

an upper edge boss disposed at an upper edge of each of the first cover seating portion and the second cover seating portion, a lower edge boss disposed at a lower edge of each of the first cover seating portion and the second cover seating portion, an outer central boss disposed at an outer side surface edge of each of the first cover seating portion and the second cover seating portion, and an inner central boss disposed at an inner side surface edge of each of the first cover seating portion and the second cover seating portion.

2. The laundry treating apparatus of claim 1, wherein the hinge cover and the latch cover are symmetrical to each other with respect to the vertical line, and wherein each of the hinge cover and the latch cover is symmetrical with respect to the horizontal line.

3. The laundry treating apparatus of claim 2, wherein each of the hinge cover and the latch cover comprises:

a front surface portion that defines a portion of the rear surface of the door frame; and a side bent portion that is bent from an outer side edge of the front surface portion toward the door cover and that defines a portion of a circumferential surface of the door.

4. The laundry treating apparatus of claim 3, wherein the front surface portion has:

an upper edge hole defined at an upper portion of the front surface portion and configured to face the upper edge boss;

a lower edge hole defined at a lower portion of the front surface portion vertically below the upper portion and configured to face the lower edge boss;

an outer central hole defined at an outer side portion of the front surface portion between the upper portion and the lower portion and configured to face the outer central boss; and an inner central hole defined at an inner side portion of the front surface portion radially inward of the outer side portion and configured to face the inner central boss.

5. The laundry treating apparatus of claim 4, wherein a center of the inner central hole and a center of the outer central hole are positioned at the horizontal line.

6. The laundry treating apparatus of claim 4, wherein the upper edge hole and the lower edge hole are located at positions symmetrical to each other with respect to the horizontal line.

7. The laundry treating apparatus of claim 1, wherein the outer central boss comprises a plurality of outer central bosses, and wherein the hinge cover comprises a plurality of outer central holes, a number of the plurality of outer central holes corresponding to a number of the plurality of outer central bosses.

8. The laundry treating apparatus of claim 1, wherein a center of the door is passed by the horizontal line.

9. The laundry treating apparatus of claim 1, wherein the hinge assembly is configured to couple to one of the first cover seating portion or the second cover seating portion, and wherein the hinge cover is configured to completely cover the one of the first cover seating portion or the second cover seating portion that is coupled to the hinge assembly.

10. The laundry treating apparatus of claim 1, wherein the hinge body comprises:

a hinge head fixed to a front surface of the cabinet that defines an edge of the laundry receiving hole;

at least one hinge leg that extends from the hinge head in a first direction; and a hinge shaft that extends from a distal end of the hinge leg in a second direction perpendicular to the first direction.

11. The laundry treating apparatus of claim 10, wherein the hinge assembly further comprises one or more hinge bearings that contact an outer circumferential surface of the hinge shaft, and wherein each of the hinge cover and the hinge base defines one or more bearing receiving grooves that receive the one or more hinge bearings, respectively.

12. The laundry treating apparatus of claim 1, wherein the latch cover is configured to completely cover any of the first cover seating portion or the second cover seating portion.

13. The laundry treating apparatus of claim 11, wherein the one or more hinge bearings are located between the hinge cover and the hinge base.

14. The laundry treating apparatus of claim 1, wherein each of the first cover seating portion and the second cover seating portion is configured to seat any of the hinge assembly or the latch assembly.

15. The laundry treating apparatus of claim 1, wherein each of the first cover seating portion and the second cover seating portion comprises a recessed surface that is recessed from the rear surface of the door frame toward the door cover.

16. The laundry treating apparatus of claim 3, wherein the front surface portion of the latch cover defines a latch hole at a position that the horizontal line passes.

17. The laundry treating apparatus of claim 3, wherein each of the latch cover and the hinge cover further comprises:

an upper mount rib that extends from a top edge of the front surface portion toward the door cover;

a lower mount rib that extends from a bottom edge of the front surface portion toward the door cover, the bottom edge being located vertically below the top edge; and a side mount rib that extends from an inner side edge of the front surface portion toward the door cover, the inner side edge being spaced apart from and facing the outer side edge of the front surface portion, and wherein the side mount rib is located between the upper mount rib and the lower mount rib.

18. The laundry treating apparatus of claim 17, wherein the horizontal line passes through a center of the side mount rib.

19. The laundry treating apparatus of claim 10, wherein the hinge body further comprises a plurality of fixing hooks that protrude from the hinge head toward the front surface of the cabinet and that are arranged symmetrically with respect to the horizontal line.

* * * * *